US008616014B2

(12) United States Patent
Stover et al.

(10) Patent No.: US 8,616,014 B2
(45) Date of Patent: Dec. 31, 2013

(54) COMPRESSOR HAVING CAPACITY MODULATION OR FLUID INJECTION SYSTEMS

(75) Inventors: Robert C. Stover, Versailles, OH (US); Masao Akei, Miamisburg, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 625 days.

(21) Appl. No.: 12/789,105

(22) Filed: May 27, 2010

(65) Prior Publication Data

US 2010/0300659 A1 Dec. 2, 2010

Related U.S. Application Data

(60) Provisional application No. 61/182,578, filed on May 29, 2009.

(51) Int. Cl.
*F25B 1/00* (2006.01)

(52) U.S. Cl.
USPC ..... 62/228.1; 62/324.6

(58) Field of Classification Search
USPC ..... 62/228.1, 324.6, 215, 226, 498; 418/55.1, 55.2, 55.4, 57, 24; 165/104.31, 104.32; 417/310, 410.5, 417/440
See application file for complete search history.

(56) References Cited

U.S. PATENT DOCUMENTS 4,382,370 A 5/1983 Suefuji et al.
4,383,805 A 5/1983 Teegarden et al.
4,431,388 A 2/1984 Eber et al.
4,497,615 A 2/1985 Griffith
4,669,962 A 6/1987 Mizuno et al.
4,767,293 A * 8/1988 Caillat et al. ..... 418/55.3
4,774,816 A 10/1988 Uchikawa et al.
(Continued)

FOREIGN PATENT DOCUMENTS

CN 1060699 A 4/1992
CN 1576603 A 2/2005
(Continued)

OTHER PUBLICATIONS

International Search Report regarding Application No. PCT/US2010/036586, mailed Jan. 17, 2011.
(Continued)

*Primary Examiner* — Mohammad M Ali
(74) *Attorney, Agent, or Firm* — Harness, Dickey & Pierce, P.L.C.

(57) ABSTRACT

A compressor may include first and second scroll members and first and second pistons. The first scroll member includes a first end plate and a first scroll wrap. The second scroll member includes a second end plate and a second scroll wrap that is intermeshed with the first scroll wrap to define moving fluid pockets. The second end plate may include a first and second passages, first and second recesses, and first and second ports extending through the second end plate and communicating with at least one of the pockets. The first piston may be disposed in the first recess and movable between first and second positions controlling communication between the first passage and the first port. The second piston may be disposed in the second recess and movable between first and second positions controlling communication between at least one of the pockets and said second passage.

20 Claims, 8 Drawing Sheets

(56) References Cited

U.S. PATENT DOCUMENTS

| | | | | |
|---|---|---|---|---|
| 4,818,195 | A | 4/1989 | Murayama et al. | |
| 4,904,164 | A | 2/1990 | Mabe et al. | |
| 4,940,395 | A | 7/1990 | Yamamoto et al. | |
| 5,074,760 | A | 12/1991 | Hirooka et al. | |
| 5,156,539 | A | 10/1992 | Anderson et al. | |
| RE34,148 | E | 12/1992 | Terauchi et al. | |
| 5,169,294 | A | 12/1992 | Barito | |
| 5,192,195 | A | 3/1993 | Iio et al. | |
| 5,193,987 | A | 3/1993 | Iio et al. | |
| 5,240,389 | A | 8/1993 | Oikawa et al. | |
| 5,336,058 | A | 8/1994 | Yokoyama | |
| 5,356,271 | A | 10/1994 | Miura et al. | |
| 5,451,146 | A | 9/1995 | Inagaki et al. | |
| 5,551,846 | A | 9/1996 | Taylor et al. | |
| 5,557,897 | A | 9/1996 | Kranz et al. | |
| 5,562,426 | A | 10/1996 | Watanabe et al. | |
| 5,577,897 | A | 11/1996 | Inagaki et al. | |
| 5,607,288 | A | 3/1997 | Wallis et al. | |
| 5,611,674 | A * | 3/1997 | Bass et al. | 417/220 |
| 5,639,225 | A | 6/1997 | Matsuda et al. | |
| 5,674,058 | A | 10/1997 | Matsuda et al. | |
| 5,678,985 | A | 10/1997 | Brooke et al. | |
| 5,741,120 | A * | 4/1998 | Bass et al. | 417/44.2 |
| 5,803,716 | A * | 9/1998 | Wallis et al. | 417/310 |
| 5,833,442 | A * | 11/1998 | Park et al. | 418/1 |
| 5,855,475 | A | 1/1999 | Fujio et al. | |
| 5,885,063 | A | 3/1999 | Makino et al. | |
| 5,993,171 | A | 11/1999 | Higashiyama | |
| 5,993,177 | A | 11/1999 | Terauchi et al. | |
| 5,996,364 | A | 12/1999 | Lifson et al. | |
| 6,077,057 | A | 6/2000 | Hugenroth et al. | |
| 6,086,335 | A | 7/2000 | Bass et al. | |
| 6,102,671 | A | 8/2000 | Yamamoto et al. | |
| 6,123,517 | A * | 9/2000 | Brooke et al. | 417/299 |
| 6,132,179 | A | 10/2000 | Higashiyama | |
| 6,164,940 | A | 12/2000 | Terauchi et al. | |
| 6,176,686 | B1 | 1/2001 | Wallis et al. | |
| 6,210,120 | B1 | 4/2001 | Hugenroth et al. | |
| 6,213,731 | B1 | 4/2001 | Doepker et al. | |
| 6,231,316 | B1 | 5/2001 | Wakisaka et al. | |
| 6,273,691 | B1 | 8/2001 | Morimoto et al. | |
| 6,293,767 | B1 | 9/2001 | Bass | |
| 6,350,111 | B1 | 2/2002 | Perevozchikov et al. | |
| 6,412,293 | B1 | 7/2002 | Pham et al. | |
| 6,413,058 | B1 | 7/2002 | Williams et al. | |
| 6,454,551 | B2 | 9/2002 | Kuroki et al. | |
| 6,464,481 | B2 | 10/2002 | Tsubai et al. | |
| 6,506,036 | B2 | 1/2003 | Tsubai et al. | |
| 6,544,016 | B2 | 4/2003 | Gennami et al. | |
| 6,558,143 | B2 | 5/2003 | Nakajima et al. | |
| 6,589,035 | B1 | 7/2003 | Tsubono et al. | |
| 6,769,888 | B2 | 8/2004 | Tsubono et al. | |
| 6,821,092 | B1 | 11/2004 | Gehret et al. | |
| 6,881,046 | B2 | 4/2005 | Shibamoto et al. | |
| 6,884,042 | B2 | 4/2005 | Zili et al. | |
| 6,984,114 | B2 | 1/2006 | Zili et al. | |
| 7,118,358 | B2 | 10/2006 | Tsubono et al. | |
| 7,137,796 | B2 | 11/2006 | Tsubono et al. | |
| 7,229,261 | B2 | 6/2007 | Morimoto et al. | |
| 7,326,039 | B2 | 2/2008 | Kim et al. | |
| 7,344,365 | B2 | 3/2008 | Takeuchi et al. | |
| RE40,257 | E * | 4/2008 | Doepker et al. | 417/310 |
| 7,354,259 | B2 | 4/2008 | Tsubono et al. | |
| RE40,344 | E | 5/2008 | Perevozchikov et al. | |
| 7,404,706 | B2 | 7/2008 | Ishikawa et al. | |
| 7,513,753 | B2 | 4/2009 | Shin et al. | |
| 7,547,202 | B2 | 6/2009 | Knapke | |
| 7,771,178 | B2 | 8/2010 | Perevozchikov et al. | |
| 7,967,582 | B2 | 6/2011 | Akei et al. | |
| 7,967,583 | B2 | 6/2011 | Stover et al. | |
| 7,972,125 | B2 | 7/2011 | Stover et al. | |
| 7,976,295 | B2 | 7/2011 | Stover et al. | |
| 7,976,296 | B2 | 7/2011 | Stover et al. | |
| 7,988,433 | B2 | 8/2011 | Akei et al. | |
| 7,988,434 | B2 | 8/2011 | Stover et al. | |
| 8,313,318 | B2 | 11/2012 | Stover et al. | |
| 2001/0010800 | A1 | 8/2001 | Kohsokabe et al. | |
| 2002/0039540 | A1 | 4/2002 | Kuroki et al. | |
| 2004/0071571 | A1 | 4/2004 | Uchida et al. | |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0053507 | A1 | 3/2005 | Takeuchi et al. | |
| 2006/0165542 | A1 * | 7/2006 | Sakitani et al. | 418/60 |
| 2007/0053782 | A1 * | 3/2007 | Okamoto et al. | 418/30 |
| 2007/0092390 | A1 | 4/2007 | Ignatiev et al. | |
| 2007/0237664 | A1 | 10/2007 | Joo et al. | |
| 2007/0245892 | A1 * | 10/2007 | Lemke et al. | 92/169.1 |
| 2008/0025861 | A1 * | 1/2008 | Okawa et al. | 418/178 |
| 2008/0159892 | A1 | 7/2008 | Huang et al. | |
| 2009/0068048 | A1 | 3/2009 | Stover et al. | |
| 2009/0071183 | A1 | 3/2009 | Stover et al. | |
| 2009/0196781 | A1 | 8/2009 | Kiem et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0033328 | A1 | 2/2011 | Stover et al. | |
| 2011/0103988 | A1 | 5/2011 | Stover et al. | |
| 2011/0256009 | A1 | 10/2011 | Stover et al. | |

FOREIGN PATENT DOCUMENTS

| | | | |
|---|---|---|---|
| CN | 1707104 | A | 12/2005 |
| JP | 03081588 | A | 4/1991 |
| JP | 05001677 | A | 1/1993 |
| JP | 2000161263 | A | 6/2000 |
| JP | 2007154761 | A | 6/2007 |

OTHER PUBLICATIONS

Written Opinion of the International Searching Authority regarding Application No. PCT/US2010/036586, mailed Jan. 17, 2011.

International Search Report dated Jan. 4, 2010 regarding International Application No. PCT/US2009/045666.

International Search Report dated Jan. 21, 2010 regarding International Application No. PCT/US2009/045638.

Written Opinion of the International Searching Authority dated Jan. 21, 2010 regarding International Application No. PCT/US2009/045638, 3 pages.

International Search Report dated Jan. 8, 2010 regarding International Application No. PCT/US2009/045665.

International Search Report dated May 31, 2010 regarding International Application No. PCT/US2009/066551, 3 pgs.

Written Opinion of the International Searching Authority dated May 31, 2010 regarding International Application No. PCT/US2009/066551, 3 pgs.

Non-Final Office Action for U.S. Appl. No. 12/909,303, mailed Jan. 10, 2013.

International Search Report dated Jan. 14, 2010 regarding International Application No. PCT/US2009/045672.

Written Opinion of the International Searching Authority dated Jan. 14, 2010 regarding International Application No. PCT/US2009/045672.

Non-Final Office Action for U.S. Appl. No. 13/367,950, mailed Jan. 11, 2013.

Non-Final Office Action for U.S. Appl. No. 13/167,192, mailed Jan. 25, 2013.

First Office Action regarding Chinese Patent Application No. 200980126961.4, dated Feb. 5, 2013. English translation provided by Unitalen Attorneys at Law.

Written Opinion of the International Searching Authority dated Jan. 4, 2010 regarding Inernational Application No. PCT/US2009/045666.

(56) References Cited

OTHER PUBLICATIONS

Written Opinion of the International Search Authority dated Jan. 8, 2010 regarding International Application No. PCT/US2009/045665.
First Office Action and Search Report regarding Chinese Patent Application No. 2009801269629, issued on Apr. 2, 2013. English translation provided by Unitalen Attorneys at Law.
Final Office Action for U.S. Appl. No. 13/167,192, mailed Jun. 11, 2013.
Final Office Action regarding U.S. Appl. No. 13/165,306, dated Jun. 26, 2013.
First Office Action regarding Chinese Patent Application No. 200980125441.1, dated May 31, 2013. English translation provided by Unitalen Attorneys At Law.

* cited by examiner

COMPRESSOR HAVING CAPACITY MODULATION OR FLUID INJECTION SYSTEMS

CROSS-REFERENCE TO RELATED APPLICATIONS

This application claims the benefit of U.S. Provisional Application No. 61/182,578, filed on May 29, 2009. The entire disclosure of the above application is incorporated herein by reference.

FIELD

The present disclosure relates to compressors, and more specifically to compressors having a capacity modulation system and/or a fluid injection system.

BACKGROUND

This section provides background information related to the present disclosure and which is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. Efficient and reliable operation of the compressor is desirable to ensure that the cooling, refrigeration, or heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor that may include a shell, first and second scroll members, and first and second pistons. The shell defines a suction pressure region. The first scroll member may include a first end plate having a first scroll wrap extending therefrom. The second scroll member may include a second end plate having a second scroll wrap extending therefrom and being intermeshed with the first scroll wrap to define fluid pockets moving from a radially outer position to a radially inner position. The second end plate including first and second passages, first and second recesses, and first and second ports extending through the second end plate and communicating with at least one of the fluid pockets. The first piston may be disposed in the first recess and movable between a first position allowing fluid communication between the first passage and the first port and a second position preventing fluid communication between the first passage and the first port. The second piston may be disposed in the second recess and movable between a first position allowing fluid communication between the second port and the second passage and a second position preventing fluid communication between the second port and the second passage.

A system may include the compressor, first and second heat exchangers in communication with the compressor, and a fluid injection source in communication with the fluid injection passage. The fluid injection source may be in fluid communication with the first port when the first piston is in the first position and fluidly isolated from the first port when the first piston is in the second position.

In some forms, the compressor may include a modulation assembly that may include one or more variable volume ratio mechanisms, one or more fluid injection mechanisms, or a variable volume ratio mechanism and a fluid injection mechanism. The one or more variable volume ratio mechanisms may selectively allow communication between the suction-pressure region or a discharge-pressure region of the compressor and the first and/or second ports. The one or more fluid injection mechanisms may selectively allow communication between the fluid injection source and the first and/or second ports. The fluid injection source may provide vapor, liquid, or a mixture of vapor and liquid refrigerant or other working fluid to one or more of the fluid pockets through the first and/or second ports. The fluid injection source may be a flash tank or a plate-heat exchanger, for example.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
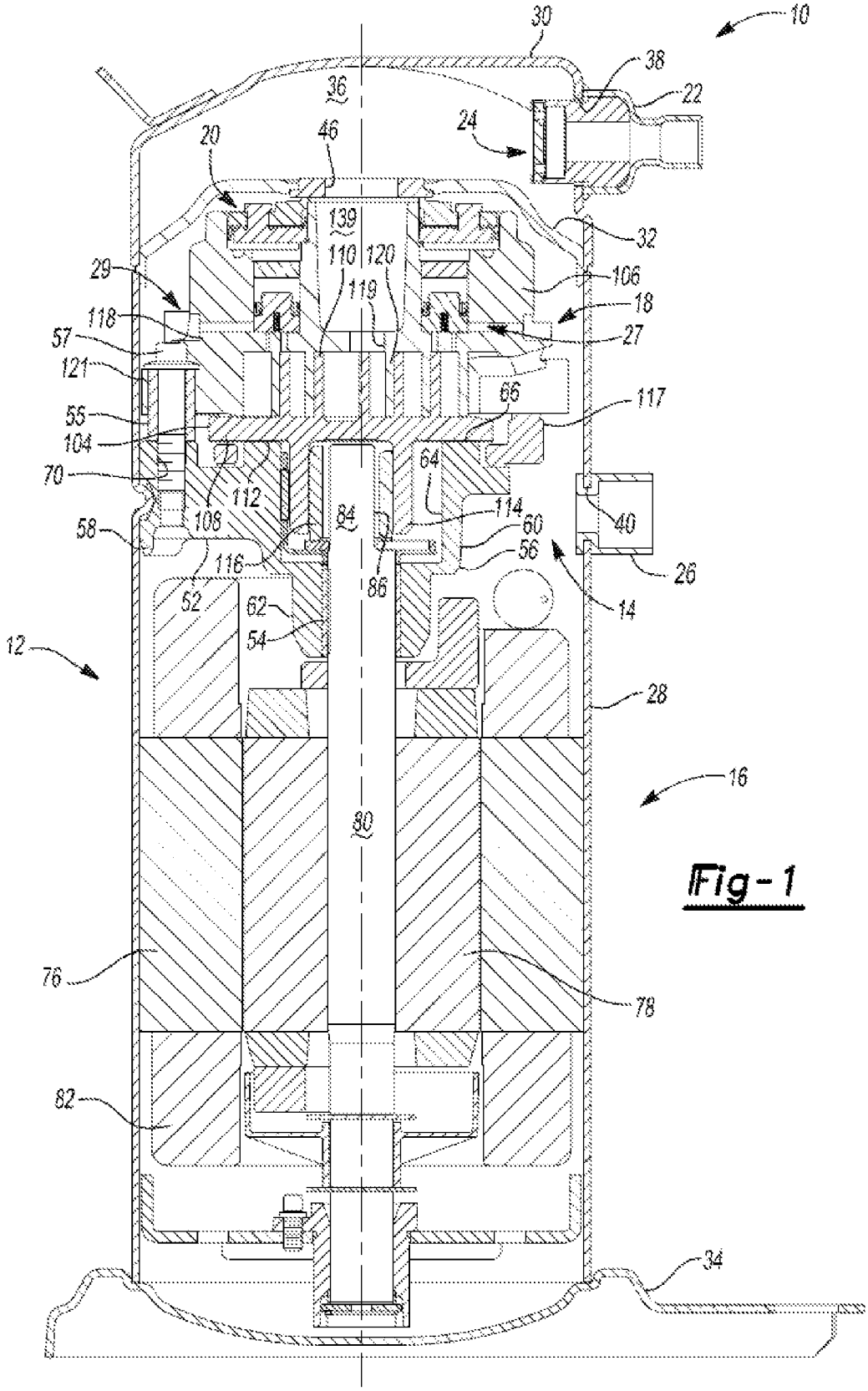
FIG. 1 is a cross-sectional view of a compressor having a modulation assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence, order or quantity unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, the compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, a modulation assembly 27, and a fluid supply passage 29. The compressor 10 may circulate fluid throughout a fluid circuit (FIG. 16) of a heat pump or climate control system 11, for example. The modulation assembly 27 may include one or more variable volume ratio mechanisms, one or more fluid injection mechanisms, or a variable volume ratio mechanism and a fluid injection mechanism.

The shell assembly 12 may house the main bearing housing assembly 14, the motor assembly 16, and the compression mechanism 18. The shell assembly 12 may generally form a compressor housing and may include a cylindrical shell 28, an end cap 30 at the upper end thereof, a transversely extending partition 32, and a base 34 at a lower end thereof. The end cap 30 and partition 32 may generally define a discharge chamber 36. The discharge chamber 36 may generally form a discharge muffler for the compressor 10. The refrigerant discharge fitting 22 may be attached to the shell assembly 12 at the opening 38 in the end cap 30. The discharge valve assembly 24 may be located within the discharge fitting 22 and may generally prevent a reverse flow condition. The suction gas inlet fitting 26 may be attached to the shell assembly 12 at opening 40. The partition 32 may include a discharge passage 46 therethrough providing communication between the compression mechanism 18 and the discharge chamber 36.

The main bearing housing assembly 14 may be affixed to the shell 28 at a plurality of points in any desirable manner, such as staking. The main bearing housing assembly 14 may include a main bearing housing 52, a first bearing 54 disposed therein, bushings 55, and fasteners 57. The main bearing housing 52 may include a central body portion 56 having a series of arms 58 extending radially outwardly therefrom. The central body portion 56 may include first and second portions 60, 62 having an opening 64 extending therethrough. The second portion 62 may house the first bearing 54 therein. The first portion 60 may define an annular flat thrust bearing surface 66 on an axial end surface thereof. The arm 58 may include apertures 70 extending therethrough and receiving the fasteners 57.

The motor assembly 16 may generally include a motor stator 76, a rotor 78, and a drive shaft 80. Windings 82 may pass through the stator 76. The motor stator 76 may be press fit into the shell 28. The drive shaft 80 may be rotatably driven by the rotor 78. The rotor 78 may be press fit on the drive shaft 80. The drive shaft 80 may include an eccentric crank pin 84 having a flat 86 thereon.

The compression mechanism 18 may generally include an orbiting scroll 104 and a non-orbiting scroll 106. The orbiting scroll 104 may include an end plate 108 having a spiral vane or wrap 110 on the upper surface thereof and an annular flat thrust surface 112 on the lower surface. The thrust surface 112 may interface with the annular flat thrust bearing surface 66 on the main bearing housing 52. A cylindrical hub 114 may project downwardly from the thrust surface 112 and may have a drive bushing 116 rotatively disposed therein. The drive bushing 116 may include an inner bore in which the crank pin 84 is drivingly disposed. The crank pin flat 86 may drivingly engage a flat surface in a portion of the inner bore of the drive bushing 116 to provide a radially compliant driving arrangement. An Oldham coupling 117 may be engaged with the orbiting and non-orbiting scrolls 104, 106 to prevent relative rotation therebetween.

The non-orbiting scroll 106 may include an end plate 118 having a spiral wrap 120 on a lower surface thereof, a discharge passage 119 extending through the end plate 118, and a series of radially outwardly extending flanged portions 121. The spiral wrap 120 may meshingly engage the wrap 110 of the orbiting scroll 104, thereby creating a series of moving fluid pockets. The fluid pockets defined by the spiral wraps 110, 120 may decrease in volume as they move from a radially outer position (at a suction pressure) to a radially intermediate position (at an intermediate pressure) to a radially inner position (at a discharge pressure) throughout a compression cycle of the compression mechanism 18.

Referring now to FIGS. 2-5, the end plate 118 may include an annular recess 134 in the upper surface thereof defined by parallel coaxial inner and outer side walls 136, 138. The inner side wall 136 may form a discharge passage 139. The end plate 118 may further include first and second discrete recesses 140, 142. The first and second recesses 140, 142 may be located within the annular recess 134. Plugs 144, 146 may be secured to the end plate 118 at a top of the first and second recesses 140, 142 to form first and second chambers 145, 147 isolated from the annular recess 134.

A first passage 150 may extend radially through the end plate 118 and fluidly couple a first portion 152 (FIG. 4) of first chamber 145 and the fluid supply passage 29. A second passage 154 (FIG. 2) may extend radially through the end plate 118 from a second portion 156 of the first chamber 145 to an outer surface of the non-orbiting scroll 106.

A third passage 158 may extend radially through the end plate 118 from a first portion 160 (FIG. 5) of the second chamber 147 to an outer surface of the non-orbiting scroll 106. A fourth passage 162 (FIG. 2) may extend radially through the end plate 118 from a second portion 164 of the second chamber 147 to an outer surface of the non-orbiting scroll 106. The third passage 158 may be in fluid communication with a suction pressure region of the compressor 10.

A fifth passage 166 and a sixth passage 167 (FIG. 2) may extend radially through the end plate 118 in generally opposite directions from a discharge pressure region of the compressor 10 to an outer surface of the non-orbiting scroll 106. For example, the fifth and sixth passages 166, 167 may extend from the discharge passage 139 to an outer surface of the non-orbiting scroll 106.

A first set of ports 168, 170 may extend through the end plate 118 and may be in communication with the moving fluid pockets operating at an intermediate pressure. The port 168 may extend into first portion 152 of the first chamber 145 and the port 170 may extend into the first portion 160 of the second chamber 147. An additional set of ports 172, 174 may extend through the end plate 118 and may be in communication with additional fluid pockets operating at an intermediate pressure or at a suction pressure. The port 172 may extend into the first chamber 145 and the port 174 may extend into the second chamber 147.

Figure 2:
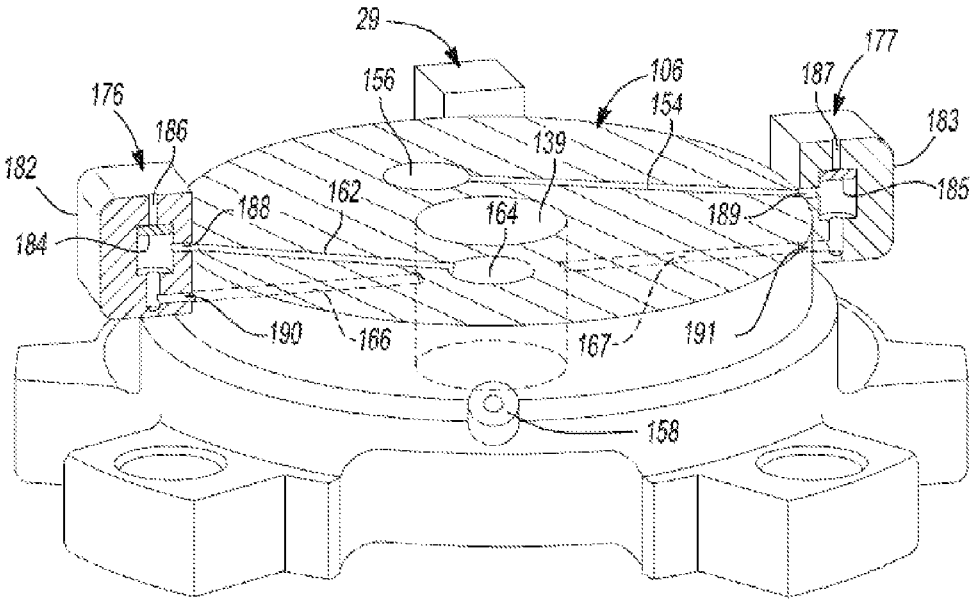
FIG. 2 is a partially cut away perspective view of a scroll member including first and second valve assemblies.
Figure 3:
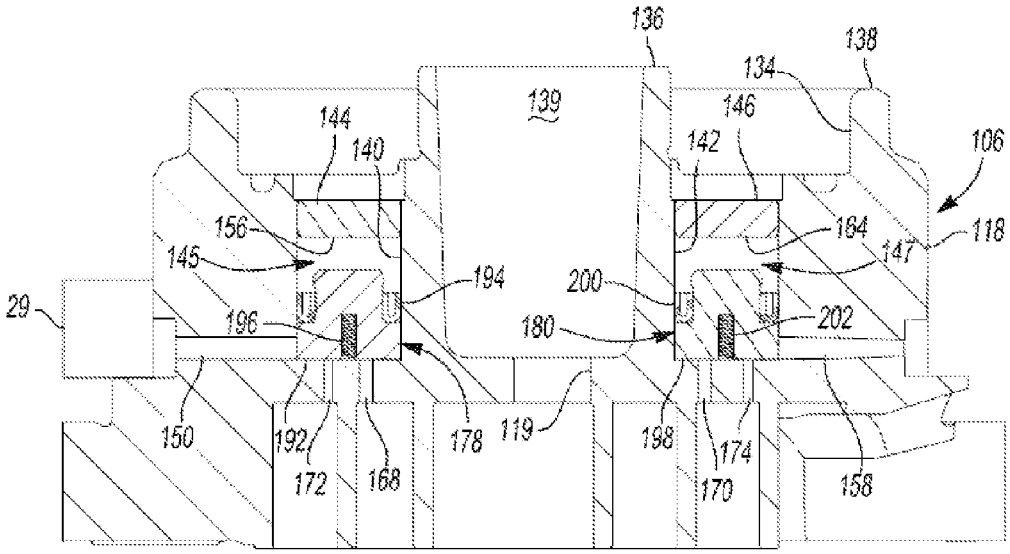
FIG. 3 is a cross-sectional view of the scroll member having first and second pistons.
Figure 4:
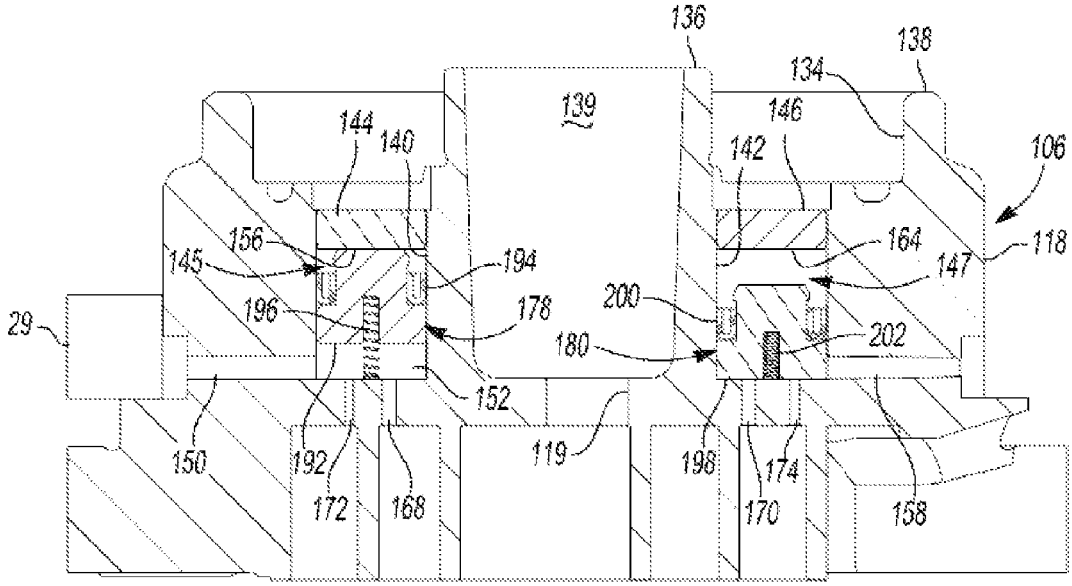
FIG. 4 is a cross-sectional view of the scroll member of FIG. 3 including the first piston in a first position and the second piston in a second position.
Figure 5:
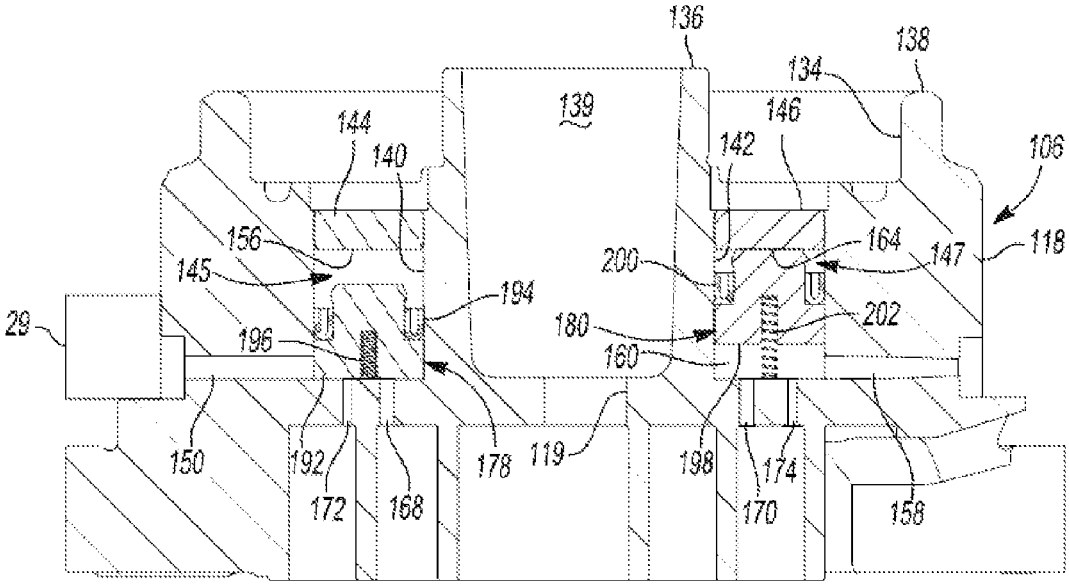
FIG. 5 is a cross-sectional view of the scroll member of FIG. 3 including the first piston in a second position and the second piston in a first position.
Figure 6:
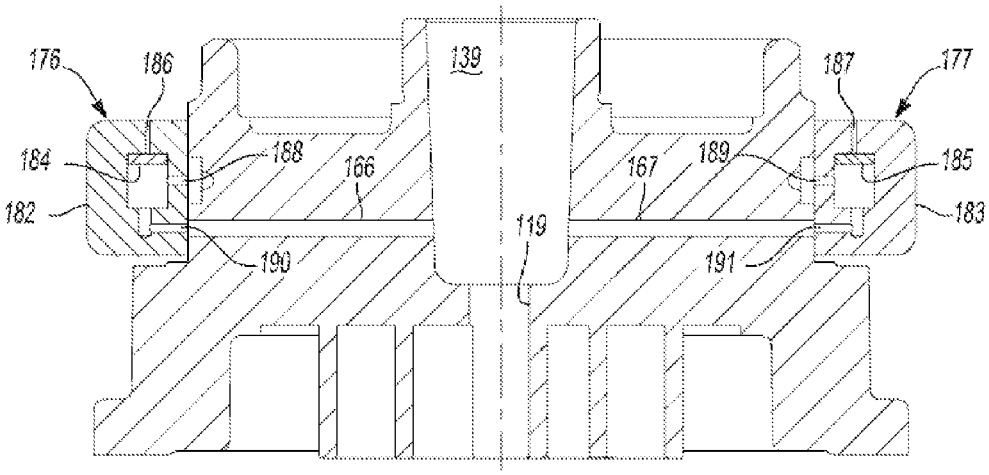
FIG. 6 is a cross-sectional view of the scroll member of FIG. 2.

Referring now to FIGS. 2-8, by way of example, the modulation assembly 27 may include a bypass valve assembly 176, a fluid injection valve assembly 177 (FIGS. 2 and 6-8), a fluid injection piston assembly 178, and a bypass piston assembly 180 (FIGS. 3-5). The valve assemblies 176, 177 may be solenoid valves, for example, or any other suitable valve type. The bypass valve assembly 176 may control operation of the bypass piston assembly 180. The fluid injection valve assembly 177 may control operation of the fluid injection piston assembly 178, as will be subsequently described.

The bypass valve assembly 176 may include a housing 182 having a valve member 184 disposed therein. Similarly, the fluid injection valve assembly 177 may include a housing 183 having a valve member 185. The housing 182 may include first, second, and third passages 186, 188, 190, and the housing 183 may include first, second, and third passages 187, 189, 191. The first passages 186, 187 may be in communication with a suction pressure region of the compressor 10. The second passage 188 of the bypass valve assembly 176 may be in communication with the second portion 164 of the second chamber 147 via the fourth passage 162 (FIG. 2). The second passage 189 of the fluid injection valve assembly 177 may be in communication with the second portion 156 of the first chamber 145 via the second passage 154 (FIG. 2). The third passages 190, 191 of the valve assemblies 176, 177, respectively, may both be in communication with the discharge passage 139 via the fifth passage 166 and the sixth passage 167, respectively.

Each of the valve members 184, 185 may be movable between first positions (i.e., upper positions relative to the views shown in FIGS. 2 and 6-8) and second positions (i.e., lower positions relative to the views shown in FIGS. 2 and 6-8). When the valve member 184 of the bypass valve assembly 176 is in the first position (FIGS. 6 and 8), the second and third passages 188, 190 are in communication with each other and isolated from the first passage 186. While the valve member 184 is in the first position, the second portion 164 of the second chamber 147 in the end plate 118 is in communication with the discharge passage 139 via the fourth passage 162 and the fifth passage 166.

Similarly, when the valve member 185 of the fluid injection valve assembly 177 is in the first position (FIGS. 6 and 7), the second and third passages 189, 191 are in communication with each other and isolated from the first passage 187. While the valve member 185 is in the first position, the second portion 156 of the first chamber 145 in the end plate 118 is in communication with the discharge passage 139 via the second passage 154 and the sixth passage 167.

When the valve member 184 of the bypass valve assembly 176 is in the second position (FIG. 7), the first and second passages 186, 188 are in communication with each other and isolated from the third passage 190. While the valve member 184 is in the second position, the second portion 164 of the second chamber 147 in the end plate 118 is in communication with the suction pressure region of the compressor 10.

Similarly, when the valve member 185 of the fluid injection valve assembly 177 is in the second position (FIG. 8), the first and second passages 187, 189 are in communication with each other and isolated from the third passage 191. While the valve member 185 is in the second position, the second portion 156 of the first chamber 145 in the end plate 118 is in communication with the suction pressure region of the compressor 10.

The fluid injection piston assembly 178 may be located in the first chamber 145 and may include a first piston 192, a seal 194 and a biasing member 196. The bypass piston assembly 180 may be located in the second chamber 147 and may include a second piston 198, a seal 200 and a biasing member 202.

The first and second pistons 192, 198 may be displaceable between first positions (i.e., upper positions relative to the views shown in FIGS. 3-5) and second positions (i.e., lower positions relative to the views shown in FIGS. 3-5). For example, the biasing member 196 may urge the first piston 192 into the first position (FIG. 4) when the valve member 185 is in the second position (FIG. 8). When the valve member 185 is in the first position (FIGS. 2, 6, and 7), the biasing force of the biasing member 196 may be overcome by the discharge pressure provided by the sixth passage 167 and the second passage 154.

Figure 7:
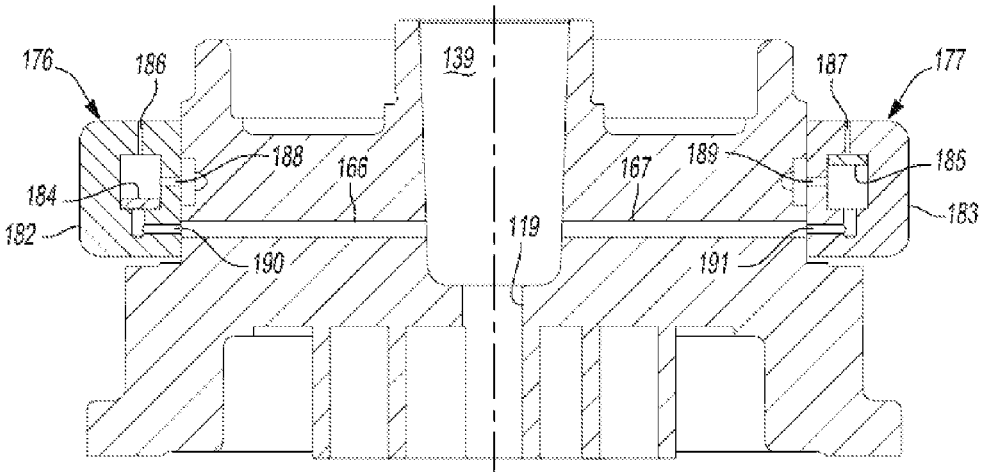
FIG. 7 is a cross-sectional view of the scroll member of FIG. 2 including the first valve assembly in a second position and the second valve assembly in a first position.
Figure 8:
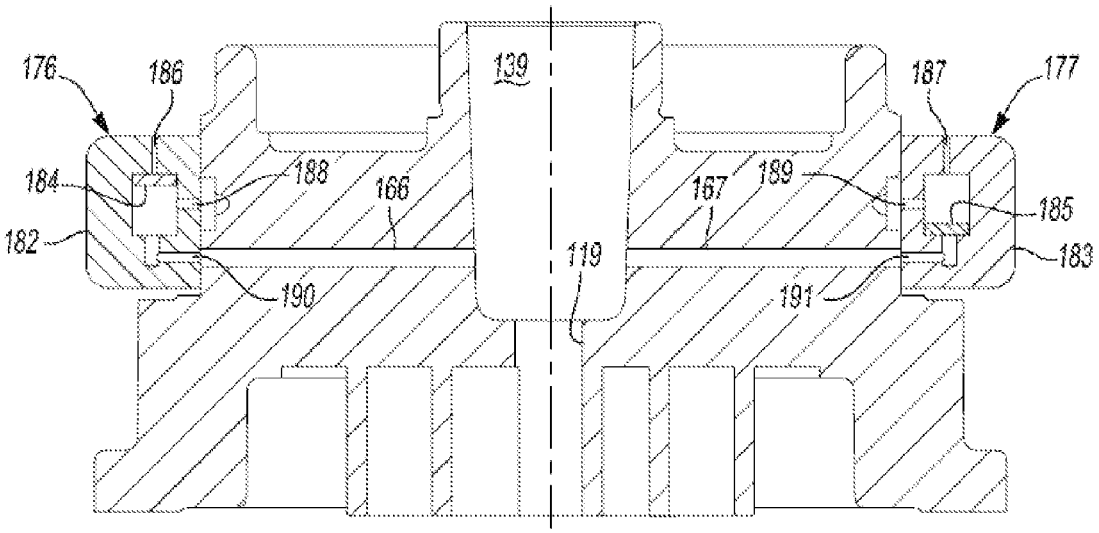
FIG. 8 is a cross-sectional view of the scroll member of FIG. 2 including the first valve assembly in a first position and the second valve assembly in a second position.

Similarly, the biasing member 202 may urge the second piston 198 into the first position (FIG. 5) when the valve member 184 is in the second position (FIG. 7). When the valve member 184 is in the first position (FIGS. 2, 6, and 8), the biasing force of the biasing member 202 may be overcome by the discharge pressure provided by the fifth passage 166 and fourth passage 162.

The seal 194 may prevent communication between the first and second passages 150, 154 when the first piston 192 is in both the first and second positions. The seal 200 may prevent communication between the third and fourth passages 158, 162 when the second piston 198 is in both the first and second positions.

When the first piston 192 is in the second position (FIGS. 3 and 5), a lower surface of the first piston 192 may prevent communication between the ports 168, 172 and the first passage 150. When the first piston 192 is in the first position (FIG. 4), the first piston 192 may be displaced away from ports 168, 172 allowing communication between ports 168, 172 and the first passage 150. Therefore, when the first piston 192 is in the first position, the ports 168, 172 may be in communication with the fluid supply passage 29 and receive fluid therefrom, thereby increasing an operating capacity and efficiency of the compressor 10 and the climate control system 11.

When the second piston 198 is in the second position (FIGS. 3 and 4), a lower surface of the second piston 198 may prevent communication between the seal ports 170, 174 and the third passage 158. When the second piston 198 is in the first position (FIG. 5), the second piston 198 may be displaced from the ports 170, 174 allowing communication between the ports 170, 174 and the third passage 158. Therefore, when the second piston 198 is in the first position, ports 170, 174 may be in communication with a suction pressure region of the compressor 10, thereby reducing an operating capacity of the compressor 10. Additionally, fluid may flow from port 170 to port 174 when the second piston 198 is in the first position.

A controller (not shown) may control the modulation assembly 27 by controlling the operation of the bypass valve assembly 176 and the fluid injection valve assembly 177. The controller may selectively provide current to solenoids of valve assemblies 176, 177 to move the valve members 184, 185 between the first and second positions. Based on demand and/or other operating conditions of the compressor 10 and/or climate control system 11, for example, the controller may cause the compressor 10 to operate in one of a normal mode (FIGS. 3 and 6), an increased capacity mode (FIGS. 4 and 8), and a reduced capacity mode (FIGS. 5 and 7). In the normal mode, both of the pistons 192, 198 are in the second position, as shown in FIG. 3. In the increased capacity mode, the first piston 192 is in the first position and the second piston 198 is in the second position, as shown in FIG. 4, thereby allowing fluid to be injected into moving fluid pockets. In the reduced capacity mode, the first piston 192 is in the second position and the second piston 198 is in the first position, as shown in FIG. 5, thereby allowing fluid to leak from moving fluid pockets. The controller may pulse width modulate or otherwise cycle the compressor 10 between or among any two or three of the operating modes.

Figure 16:
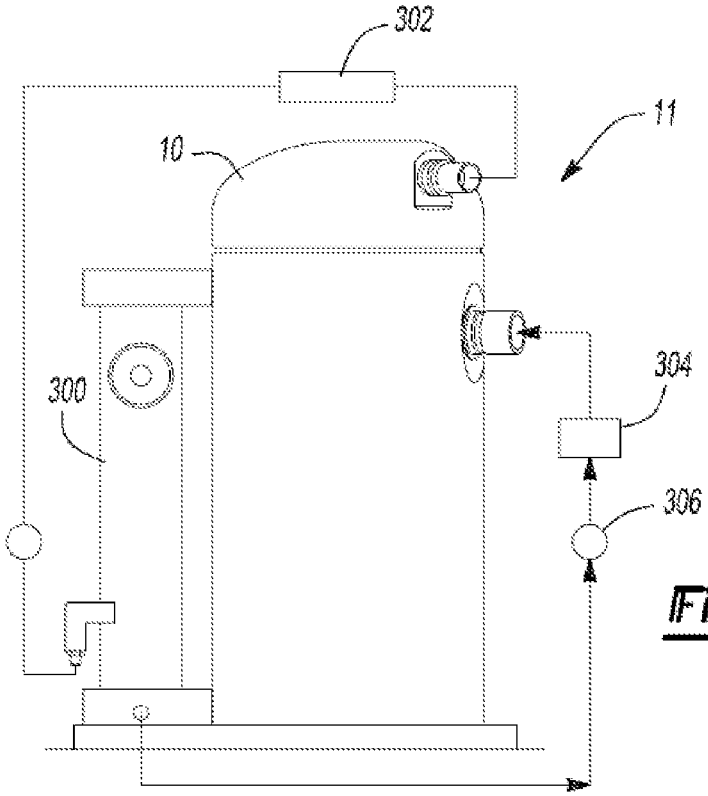
FIG. 16 is a schematic representation of a climate control system including the compressor.

Referring now to FIG. 16, a fluid injection source is in communication with the fluid supply passage 29 and may provide vapor, liquid, or a mixture of vapor and liquid refrigerant or other working fluid to the fluid supply passage 29. Therefore, the fluid supply passage 29 may form a fluid injection passage. For example, the fluid injection source may include a flash tank 300 and a conduit (not specifically shown) providing fluid communication between the flash tank 300 and the fluid supply passage 29. The flash tank 300 may be disposed between an outdoor heat exchanger 302 and an indoor heat exchanger 304. The compressor 10 may circulate a working fluid, such as a refrigerant, through the outdoor heat exchanger 302, flash tank 300, indoor heat exchanger 304, and an expansion device 306. In other embodiments, the fluid injection source could include a plate-heat exchanger or any other suitable heat exchanger in place of the flash tank 300.

In a cooling mode, the outdoor heat exchanger 302 may function as a condenser, and the indoor heat exchanger may function as an evaporator. In embodiments where the climate control system 11 is a heat pump, in a heating mode, the outdoor heat exchanger 302 may function as an evaporator and the indoor heat exchanger may function as a condenser.

The fluid injection valve assembly 177 of the present disclosure may remove the necessity for an external control valve regulating fluid communication between the flash tank and the compressor 10. However, it should be appreciated that the climate control system 11 could include such an external control valve in addition to the fluid injection valve assembly 177.

While the modulation assembly 27 is described above as having the fluid injection piston assembly 178 and the bypass piston assembly 180, in other embodiments, the modulation assembly 27 may include two or more bypass piston assemblies 180 and/or two or more fluid injection piston assemblies 178. In embodiments having two or more bypass piston assemblies 180, both or all of the bypass piston assemblies 180 may selectively allow communication between the ports 168, 170, 172, 174 and the suction-pressure region. In embodiments having two or more fluid injection piston assemblies 178, both or all of the fluid injection piston assemblies 178 may selectively allow communication between the ports 168, 170, 172, 174 and one or more fluid injection sources. In such embodiments, the one or more fluid injection sources may provide vapor, liquid, or a mixture of vapor and liquid refrigerant or other working fluid to one or both of the fluid injection piston assemblies 178.

Figure 9:
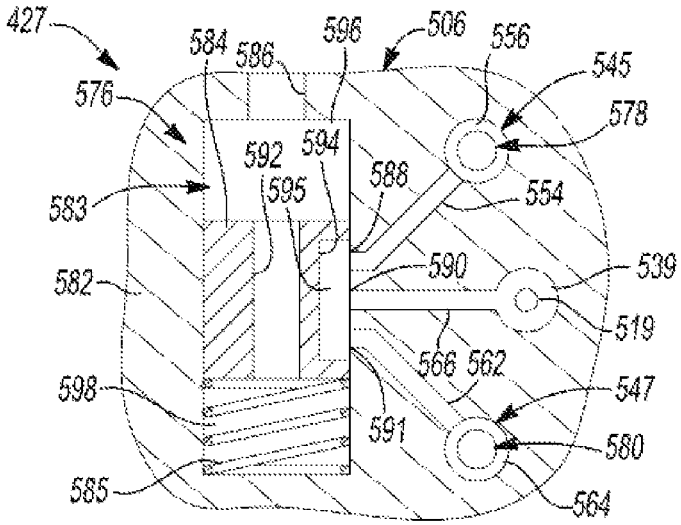
FIG. 9 is a schematic cross-sectional view of another embodiment of a valve assembly in a first position according to the principles of the present disclosure.
Figure 10:
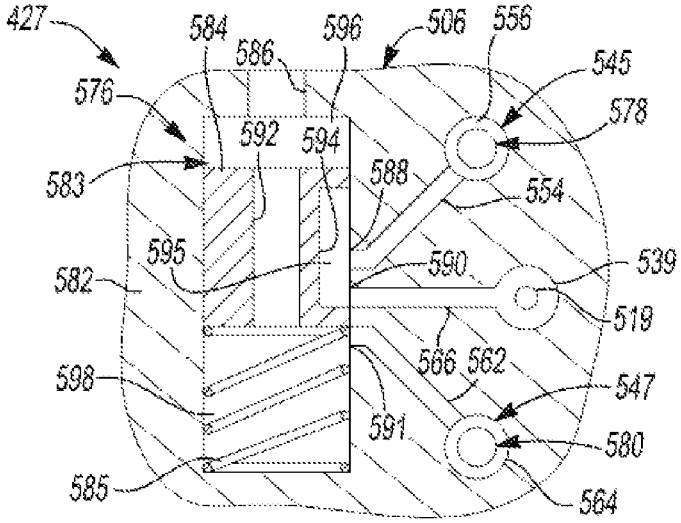
FIG. 10 is a schematic cross-sectional view of the valve assembly of FIG. 9 in a second position according to the principles of the present disclosure.
Figure 11:
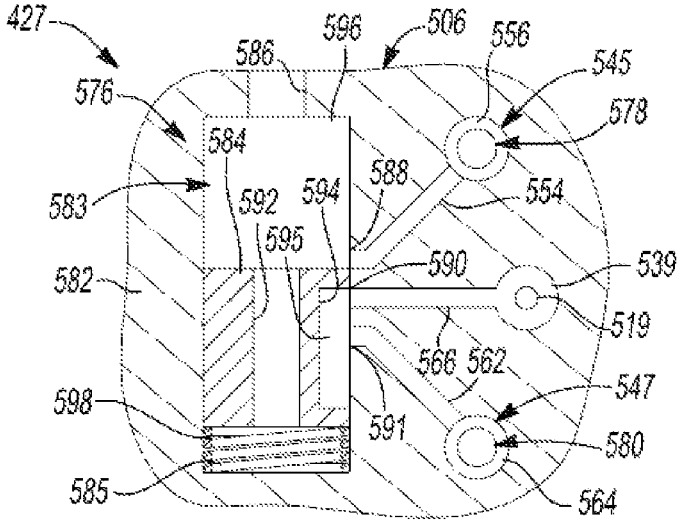
FIG. 11 is a schematic cross-sectional view of the valve assembly of FIG. 9 in a third position according to the principles of the present disclosure.

With reference to FIGS. 9-11, another modulation assembly 427 and non-orbiting scroll 506 will be described. The structure and function of the modulation assembly 427 and non-orbiting scroll 506 may be generally similar to the modulation assembly 27 and non-orbiting scroll 106 described above, apart from the exceptions noted below.

The non-orbiting scroll 506 may include a discharge passage 539, a first chamber 545, and a second chamber 547. The discharge passage 539 may be in fluid communication with a discharge passage 519. The discharge passage 519 may be generally similar to the discharge passage 119 described above and will not be described in detail with the understanding that the description above applies equally to the discharge passage 519.

The first chamber 545 may slidably engage a fluid injection piston assembly 578 and may include a portion 556 above the fluid injection piston assembly 578. The fluid injection piston assembly 578 may be generally similar to the fluid injection piston assembly 178 described above and will not be described in detail with the understanding that the description above applies equally to the fluid injection piston assembly 578. The portion 556 may be in fluid communication with a first passage 554 extending outwardly therefrom toward a perimeter of the non-orbiting scroll 506.

The second chamber 547 may slidably engage a bypass piston assembly 580 and may include a portion 564 above the bypass piston assembly 580. The bypass piston assembly 580 may be generally similar to the bypass piston assembly 180 described above and will not be described in detail with the understanding that the description above applies equally to the bypass piston assembly 580. The portion 564 may be in fluid communication with a second passage 562 extending outwardly therefrom toward the perimeter of the non-orbiting scroll 506. The discharge passage 539 may be in fluid communication with a third passage 566 that extends outwardly therefrom toward the perimeter of the non-orbiting scroll 506.

The modulation assembly 427 may include a valve assembly 576 that may control actuation of the fluid injection piston assembly 578 and the bypass piston assembly 580. The valve assembly 576 may be a four-port, three-position solenoid valve, for example, or any other type of valve.

The valve assembly 576 may include a housing 582 having a valve member 584 and a spring member 585 disposed therein. The housing 582 may be integrally formed with the non-orbiting scroll 506 or threadably fastened, press fit or otherwise secured thereto. The housing 582 may define a first cavity 583 and may include first, second, third, and fourth passages 586, 588, 590, 591. The first passage 586 may be in communication with a suction pressure region. The second passage 588 may be in communication with the portion 556 of the first chamber 545 via the first passage 554. The third passage 590 may be in communication with the discharge passage 539 via the third passage 566. The fourth passage 591 may be in communication with the portion 564 of the second chamber 547 via the second passage 562.

The valve member 584 may be a generally cylindrical member having a central passage 592 and a cutout 594 disposed radially outward relative to the central passage 592. The central passage 592 may extend axially through the valve member 584 to allow fluid communication between a first portion 596 and a second portion 598 of the first cavity 583. A second cavity 595 may be defined by the cutout 594 and a radial wall of the housing 582

The valve member 584 may be movable between a first position (FIG. 9), a second position (FIG. 10), and a third position (FIG. 11). In the first position, the second and third passages 588, 590 may be in communication with the fourth passage 591. In this manner, the portion 556 and the portion 564 of the first and second chambers 545, 547, respectively, may be in communication with the discharge passage 539. Supplying discharge gas to the portions 556, 564 of the first and second chambers 545, 547, respectively, causes the fluid injection piston assembly 578 and the bypass piston assembly 580 to close.

In the second position (FIG. 10), the second passage 588 may be in communication with the third passage 590 and isolated from the fourth passage 591. In this manner, the portion 556 may be in communication with the discharge passage 539, while the fourth passage 591 may be in communication with the suction pressure region via the first passage 586 and the central passage 592. Consequently, the portion 564 of the second chamber 547 may be in communication with the suction pressure region via the fourth passage 591 which may allow the bypass piston assembly 580 to open.

In the third position (FIG. 11), the fourth passage 591 may be in communication with the third passage 590 and isolated from the second passage 588. In this manner, the portion 564 may be in communication with the discharge passage 539, while the second passage 588 may be in communication with the suction pressure region via the first passage 586 and the central passage 592. Consequently, the portion 556 of the first chamber 545 may be in communication with the suction pressure region via the second passage 588 and allow the fluid injection piston assembly 578 to open.

When a solenoid coil (not specifically shown) actuating the valve member 584 is de-energized, the spring 585 may be at its unloaded length and may maintain the valve member 584 in the first position (FIG. 9). To move the valve member 584 into the second position (FIG. 10), the controller (not shown) may provide current to the solenoid coil in a first direction, thereby generating a magnetic force in a first direction moving the valve member 584 upward against the downward bias of the spring 585. To move the valve member 584 into the third position (FIG. 11), the controller may provide current to the solenoid coil in a second direction, thereby generating a magnetic force in a second direction moving the valve member 584 downward against the upward bias of the spring 585.

With reference to FIGS. 12-15, another modulation assembly 627 and non-orbiting scroll 706 will be described. The structure and function of the modulation assembly 627 and non-orbiting scroll 706 may be generally similar to the modulation assembly 27 and non-orbiting scroll 106 described above, apart from the exceptions noted below.

The non-orbiting scroll 706 may include a discharge passage 739, a first chamber 745, and a second chamber 747. The discharge passage 739 may be in fluid communication with the discharge passage 719. The discharge passage 719 may be generally similar to the discharge passage 119 described above and will not be described in detail with the understanding that the description above applies equally to the discharge passage 719.

The first chamber 745 may slidably engage a fluid injection piston assembly 778 and may include a portion 756 above the fluid injection piston assembly 778. The fluid injection piston assembly 778 may be generally similar to the fluid injection piston assembly 178 described above and will not be described in detail with the understanding that the description above applies equally to the fluid injection piston assembly 778.

The portion 756 may be in fluid communication with a first passage 754 extending outwardly therefrom toward a perimeter of the non-orbiting scroll 706. The second chamber 747 may slidably engage a bypass piston assembly 780 and may include a portion 764 above the bypass piston assembly 780. The bypass piston assembly 780 may be generally similar to the bypass piston assembly 180 described above and will not be described in detail with the understanding that the description above applies equally to the bypass piston assembly 780.

The portion 764 may be in fluid communication with a second passage 762 extending outwardly therefrom toward the perimeter of the non-orbiting scroll 706. The discharge passage 739 may be in fluid communication with a third passage 766 that extends outwardly therefrom toward the perimeter of the non-orbiting scroll 706.

The modulation assembly 627 may include a valve assembly 776 that may control actuation of the fluid injection piston assembly 778, and the bypass piston assembly 780. The valve assembly 776 may be a four-port, three-position solenoid valve, for example, or any other type of valve.

The valve assembly 776 may include a housing 782 having a valve member 784, a first spring member 785, and a second spring member 787 disposed therein. The first and second spring members 785, 787 may be fixed to the valve member 784. The housing 782 may be integrally formed with the non-orbiting scroll 706 or threadably fastened, press fit or otherwise secured thereto. The housing 782 may define a first cavity 783 and may include first, second, third, and fourth passages 786, 788, 790, 791. The first passage 786 may be in communication with a suction pressure region. The second passage 788 may be in communication with the portion 756 of the first chamber 745 via the first passage 754. The third passage 790 may be in communication with the discharge passage 739 via the third passage 766. The fourth passage 791 may be in communication with the portion 764 of the second chamber 747 via the second passage 762.

Figure 15:
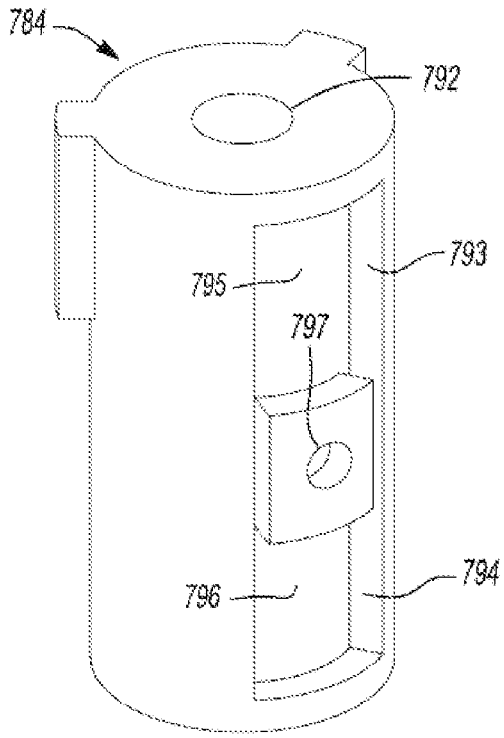
FIG. 15 is a perspective view of a valve member of the valve assembly of FIG. 12.

The valve member 784 may be a generally cylindrical member having an axial passage 792, a first cutout 793, and a second cutout 794 disposed radially outward relative to the axial passage 792. A radial passage 797 may extend radially from an outer circumference of the valve member 784 to the axial passage 792. The axial passage 792 may extend axially through the valve member 784 to allow fluid communication between the first passage 786 and the radial passage 797. A second cavity 795 may be defined by the cutout 793 and a radial wall of the housing 782. A third cavity 796 may be defined by the cutout 794 and the radial wall of the housing 782. The second and third cavities 795, 796 may be in constant fluid communication with each other, as shown in FIG. 15.

Figure 14:
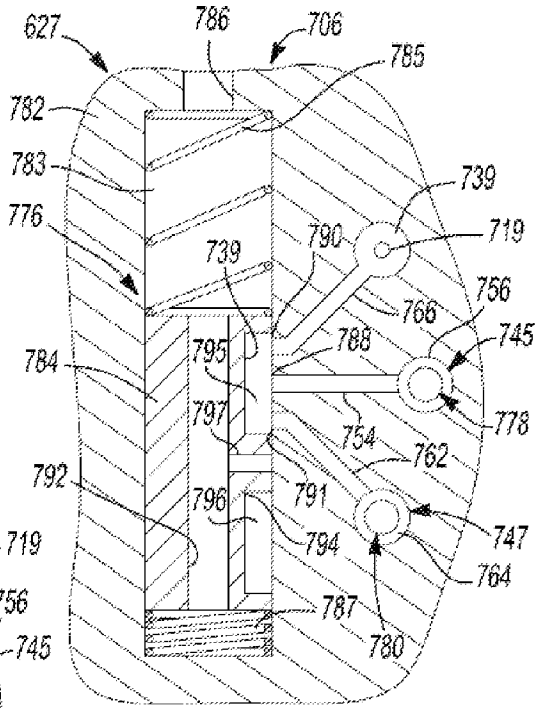
FIG. 14 is a schematic cross-sectional view of the valve assembly of FIG. 12 in a third position according to the principles of the present disclosure.
Figure 13:
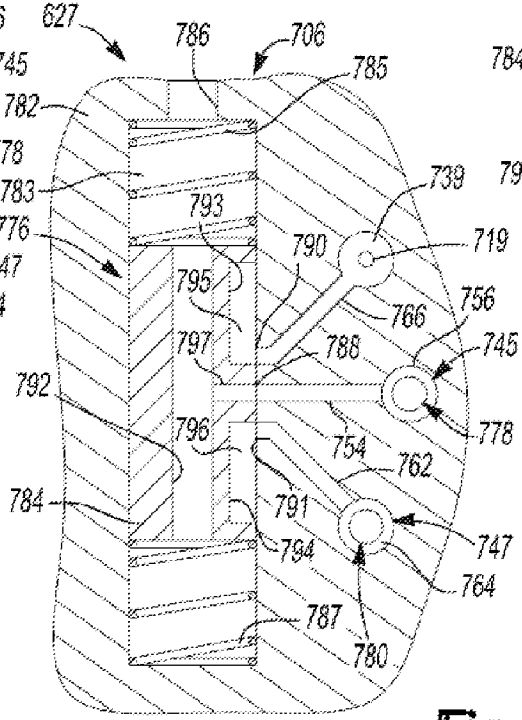
FIG. 13 is a schematic cross-sectional view of the valve assembly of FIG. 12 in a second position according to the principles of the present disclosure.

The valve member 784 may be movable between a first position (FIG. 12), a second position (FIG. 13), and a third position (FIG. 14). In the first position, the second and third passages 788, 790 are in communication with each other and isolated from the fourth passage 791. The fourth passage 791 may be in communication with the first passage 786. In this manner, the portion 756 may be in communication with the discharge passage 739, while the fourth passage 791 may be in communication with the suction pressure region via the first passage 786, the axial passage 792, and the radial passage 797. Consequently, the portion 764 of the second chamber 747 may be in communication with the suction pressure region via the fourth passage 791 which may allow the bypass piston assembly 780 to open.

In the second position, the third passage 790 and the fourth passage 791 may be in fluid communication with each other and isolated from the second passage 788. In this manner, the portion 764 may be in communication with the discharge passage 739, while the second passage 788 may be in communication with the suction pressure region via the first passage 786, the axial passage 792, and the radial passage 797. Consequently, the portion 756 of the first chamber 745 may be in communication with the suction pressure region via the second passage 788 and allow the fluid injection piston assembly 778 to open.

In the third position, the second and third passages 788, 790 may be in communication with the fourth passage 791. In this manner, the portion 756 and the portion 764 of the first and second chambers 745, 747, respectively, may be in communication the discharge passage 739. As described above, supplying discharge gas to the portions 756, 764 of the first and second chambers 745, 747, respectively, causes the fluid injection piston assembly 778 and the bypass piston assembly 780 to close.

Figure 12:
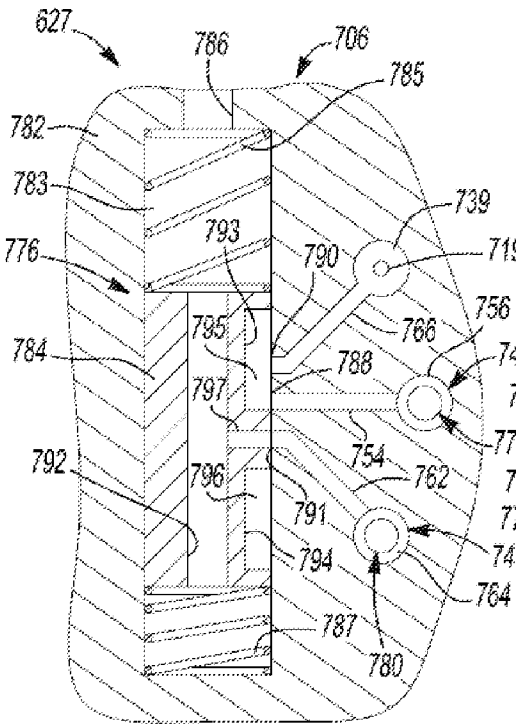
FIG. 12 is a schematic cross-sectional view of yet another embodiment of a valve assembly in a first position according to the principles of the present disclosure.

When a solenoid coil (not specifically shown) actuating the valve member 784 is de-energized, the springs 785, 787 may retain the valve member 784 in the first position (FIG. 12). To move the valve member 784 into the second position (FIG. 13), the controller (not shown) may provide current to the solenoid coil in a first direction, thereby generating a magnetic force in a first direction moving the valve member 784 upward against the downward bias of the spring 785. To move the valve member 784 into the third position (FIG. 14), the controller may provide current to the solenoid coil in a second direction, thereby generating a magnetic force in a second direction moving the valve member 784 downward against the upward bias of the spring 787.

While the valve assemblies 176, 177, 576, 776 are described above as being solenoid-actuated valves, the valve assemblies 176, 177, 576, 776 could include additional or alternative actuation means. For example, a stepper motor could move the valve members 184, 185, 584, 784 between the first, second, and third positions.

As described above, the controller may selectively cause the compressor 10 to operate in one of the normal mode (FIGS. 3, 9, and 14), the increased capacity mode (FIGS. 4, 11, and 13), and the reduced capacity mode (FIGS. 5, 10, and 12) based on demand and/or other operating conditions. The controller may pulse width modulate or otherwise cycle the compressor 10 between or among any two or three of the operating modes.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A compressor comprising:

a shell defining a suction pressure region;

a first scroll member including a first end plate having a first scroll wrap extending therefrom;

a second scroll member including a second end plate having a second scroll wrap extending therefrom and being intermeshed with said first scroll wrap to define fluid pockets moving from a radially outer position to a radially inner position, said second end plate including first and second passages, first and second recesses, and first and second ports extending through said second end plate and communicating with at least one of said fluid pockets;

a first piston disposed in said first recess and movable between a first position allowing fluid communication between said first passage and said first port and a second position preventing fluid communication between said first passage and said first port; and a second piston disposed in said second recess and movable between a first position allowing fluid communication between said second port and said second passage and a second position preventing fluid communication between said second port and said second passage.

2. The compressor of claim 1, wherein said first passage is in communication with a fluid-injection source.

3. The compressor of claim 1, wherein said second passage is in communication with said suction-pressure region.

4. The compressor of claim 1, further comprising a first valve assembly movable between a first position allowing fluid communication between said first recess and a discharge passage in said second scroll member and a second position allowing fluid communication between said first recess and said suction pressure region.

5. The compressor of claim 4, wherein said first piston is in said second position when said first recess is in fluid communication with said discharge passage, and wherein said first piston is in said first position when said first recess is in fluid communication with said suction pressure region.

6. The compressor of claim 4, further comprising a second valve assembly movable between a first position allowing fluid communication between said second recess and said discharge passage and a second position allowing fluid communication between said first recess and said suction pressure region.

7. The compressor of claim 6, wherein said second piston is in said second position when said second recess is in fluid communication with said discharge passage, and said second piston is in said first position when said second recess is in fluid communication with said suction pressure region.

8. The compressor of claim 4, wherein said first valve assembly is movable between said first and second positions and a third position allowing fluid communication between said first recess and said discharge passage and between said second recess and said discharge passage.

9. The compressor of claim 4, wherein said first valve assembly includes a solenoid valve.

10. The compressor of claim 4, wherein said first valve assembly includes a housing and a valve member disposed within said housing, said valve member having a central passage extending axially therethrough.

11. The compressor of claim 10, wherein said housing includes a first passage in communication with said suction pressure region, a second passage in communication with one of said first and second recesses, and a third passage in communication with said discharge passage.

12. The compressor of claim 11, wherein said housing includes a fourth passage in communication with another of said first and second recesses.

13. The compressor of claim 1, wherein said first and second recesses are disposed within an annular recess in said second scroll member.

14. The compressor of claim 1, further comprising a plurality of first ports and a plurality of second ports extending through said second end plate.

15. The compressor of claim 1, wherein said first and second pistons are pulse width modulated to control a capacity of the compressor.

16. A system including the compressor of claim 1, further comprising first and second heat exchangers in communication with said compressor and a fluid injection source in communication with said first passage, said fluid injection source being in fluid communication with said first port when said first piston is in said first position and fluidly isolated from said first port when said first piston is in said second position.

17. The system of claim 16, wherein said fluid injection source includes a flash tank.

18. The system of claim 16, wherein said fluid injection source includes a plate-heat exchanger.

19. The system of claim 16, wherein said fluid injection source is disposed between said first and second heat exchangers.

20. The system of claim 16, further comprising an expansion device disposed between said fluid injection source and said second heat exchanger.

* * * * *